United States Patent [19]

Nieman et al.

[11] 3,991,808

[45] Nov. 16, 1976

[54] METHOD AND APPARATUS FOR THE INTRODUCTION OF ADDITIVES INTO A CASTING MOLD

[75] Inventors: John R. Nieman; Lawrence W. McFarland, both of Pekin, Ill.

[73] Assignee: Caterpillar Tractor Co., Peoria, Ill.

[22] Filed: July 15, 1974

[21] Appl. No.: 488,758

[52] U.S. Cl. ..... 164/4; 164/57; 164/154

[51] Int. Cl.[2] ..... B22D 27/20

[58] Field of Search ..... 164/55, 56, 57, 270, 164/154, 155, 4

[56] References Cited

UNITED STATES PATENTS

| | | | |
|---|---|---|---|
| 1,596,888 | 8/1926 | Pacz | 164/56 X |
| 2,854,716 | 10/1958 | Funk et al. | 164/57 |
| 2,882,571 | 4/1959 | Easton | 164/56 |
| 3,658,115 | 4/1972 | Ryntz et al. | 164/57 |
| 3,726,331 | 4/1973 | Bunting | 164/57 |
| 3,746,070 | 7/1973 | Hill | 164/57 |
| 3,746,078 | 7/1973 | Moore et al. | 164/55 X |
| 3,851,700 | 12/1974 | McAfee et al. | 164/57 |

*Primary Examiner*—Francis S. Husar
*Assistant Examiner*—Gus T. Hampilos
*Attorney, Agent, or Firm*—John W. Grant; Robert E. Muir

[57] ABSTRACT

An apparatus for the introduction of additives into a casting mold having an internal casting cavity which is fed molten metal through a controlled flow path formed in the mold with the apparatus continuously feeding a wire of additive material into the flow path within the mold for erodibly substantially completely mixing with the molten metal prior to its entry into the casting cavity.

31 Claims, 3 Drawing Figures

METHOD AND APPARATUS FOR THE INTRODUCTION OF ADDITIVES INTO A CASTING MOLD

BACKGROUND OF THE INVENTION

The mechanical properties of metallic castings are commonly altered by the selective addition of treating agents to the molten metal prior to its being poured into a casting mold. For example, in relatively small controlled amounts, the addition of ferrosilicon is effective to refine the microstructure of cast iron for increased strength, magnesium additive increases the ductility of cast iron, and boron will improve hardenability of steel compositions. However, the effectiveness of some treating agents tends to fade immediately after their introduction into the molten metal and the benefits derived therefrom require a relatively short elapsed time between the introduction of the treating agent into the molten metal and the time at which the molten metal begins to solidify.

Various apparatus and methods have been proposed to minimize such fading. Such methods are exemplified by U.S. Pat. Nos. 2,577,837; 2,822,266; 3,367,395; 3,634,075; and 3,703,922. The method taught in U.S. Pat. No. 3,634,075 is also discussed in the Oct. 28, 1971 issue of *IRON AGE*. While these methods have generally provided improvements, they have not been completely satisfactory. For example, U.S. Pat. No. 3,703,922 to Dunks et al describes an in-mold process where the treating agent is placed in an intermediate chamber in the mold. A number of solid pieces calculated to provide the desired addition is placed in the chamber and the molten metal is poured at a carefully controlled rate to melt and pick up the treating agent as it flows through this chamber as well as the runners and gating system into the main mold cavity. However, such in-mold process has several disadvantages. The treating agents are provided in preshaped pieces with a number of such pieces approximating the amount of the agent actually required placed in the chamber. Thus, unless the amount of treating agent provided by the preshaped pieces coincides exactly with the amount required for a particular casting, costly waste of unused treating agent or a casting composition varying from the optimum will result. Furthermore, at the end of the pouring operation, a sufficiently large piece of the treating agent must remain to assure that an undissolved agglomeration of the material will not be dragged into the gating system and consequently into the mold cavity. Other undesirable effects might also result from any premature movement of the agglomerate mass within the mold tending to plug or restrict an ingate into the cavity. Also since the amount of treating agent melted by the molten metal is a function of the temperature of the molten metal, the actual quantity of the agents consumed may vary greatly between separate castings from a single pour and even within a single casting.

Other treatment processes are typically directed at adding treating agents into the molten metal in the ladle, ladle lip, or in an open stream between the ladle and the mold. Generally additions of this type are adversely affected by the increased time interval which necessarily occur between such earlier additions and solidification of the molten metal. Also this process exposes the molten metal and treating agent mixture to the atmosphere such that oxidizing may occur before the molten metal enters the casting cavity. This forms drosses, slags and oxides which are carried into the casting cavity by the molten metal and solidifies as impurities in the casting.

OBJECTS OF THE INVENTION

Accordingly, an object of this invention is to provide an improved method and apparatus for the introduction of additives into a casting mold which minimizes the elapsed time between the introduction of the additives into the molten metal and the time at which the molten metal begins to solidify.

Another object of this invention is to provide such an improved method and apparatus in which the amount of additives introduced into the casting cavity may be precisely controlled.

Another object of this invention is to provide such an improved method and apparatus which minimizes the formation of oxides, drosses and slags in the molten metal entering the casting mold.

Another object of this invention is to provide an improved method and apparatus of the character described which provides more complete homogeneous mixing of the additives within the casting than heretofore obtainable.

Other objects and advantages of the present invention will become more readily apparent upon reference to the accompanying drawings and following description.

DESCRIPTION OF THE PREFERRED EMBODIMENTS

Figure 1:
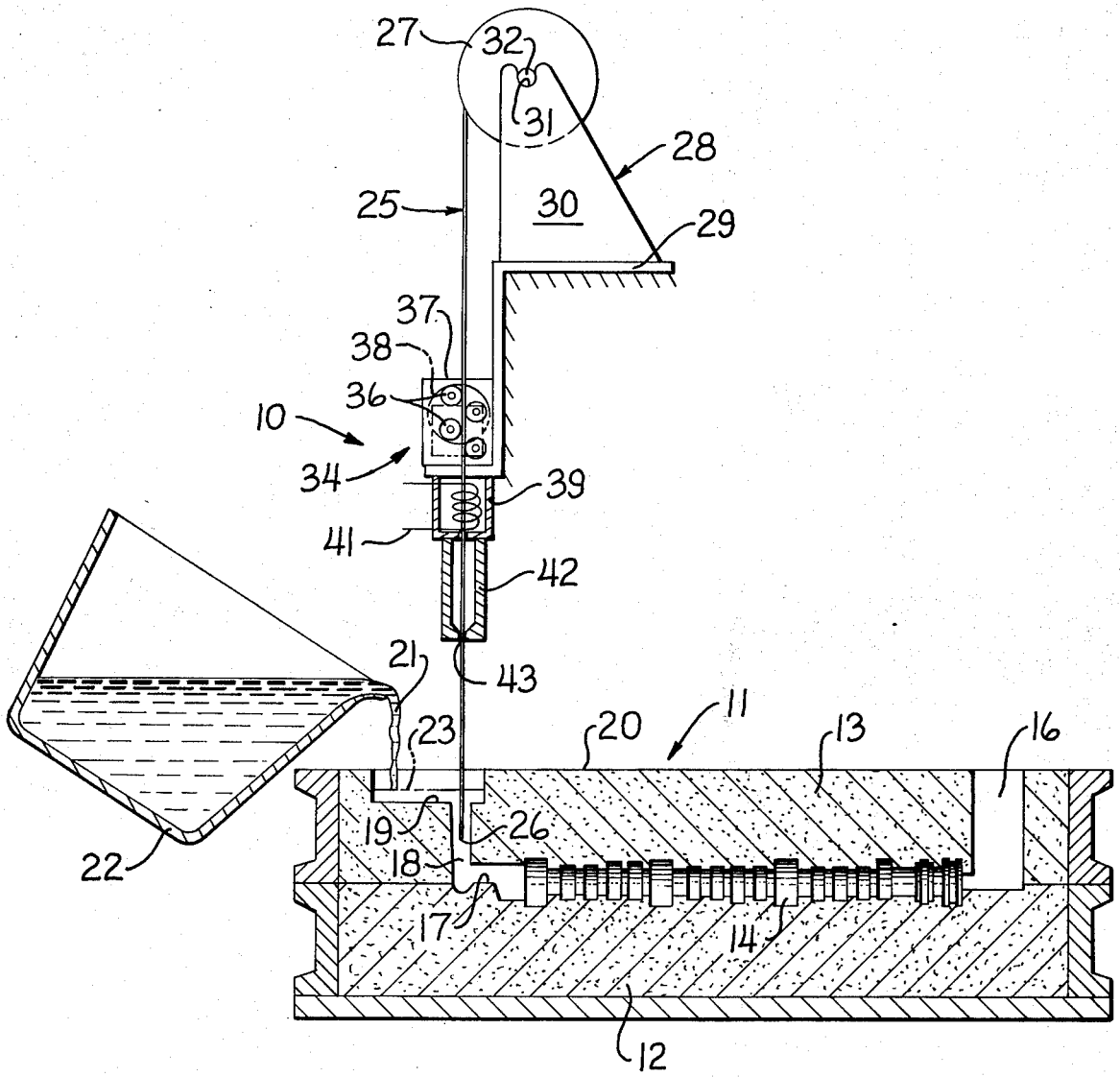
FIG. 1 is a side elevational view of an apparatus for introduction of additives into a casting mold embodying the principles of the present invention with portions shown in section for illustrative convenience.

Referring more particularly to FIG. 1 of the drawings, an apparatus for the introduction of additives into a casting mold is generally indicated by the reference numberal 10 in association with a casting mold 11. The casting mold is of the usual type and has a drag 12 and a mating cope 13 separatably fastened together in congruently stacked relation defining an internal casting cavity 14 therein. A riser 16 is connected to the cavity at one end thereof while an ingate 17 connects the opposite end of the cavity with a down sprue 18. The down sprue communicates with an open pouring basin 19 formed in an upper surface 20 of the cope. The casting mold is positioned such that the pouring basin receives a stream of molten metal 21 from a ladle 22 or the like with the molten metal in the pouring basin having a level or surface 23 maintained somewhat below the surface 20. The down sprue and ingate provide a somewhat restricted or controlled flow path for directing the molten metal into the casting cavity.

The additives utilized in the present invention are in the form of a relatively ductile wire generally indicated by the reference numeral 25 having a lower end 26 and carried by a reel or spool 27. The construction of the wire forms no part of the present invention and may be provided in any of the current forms such as a solid wire composed entirely of the additive material, a solid wire of additive material within a sheath of protective material, or a hollow core wire filled with powdered additive material.

The apparatus 10 of the present invention includes a support bracket 28 suitably mounted on a base 29. The bracket includes a pair of spaced upwardly extending arms, one of which is shown at 30, with each arm being provided with an upwardly opening notch 31 to receive a shaft 32 extending through and rotatably supporting the reel 27. A wire feed mechanism 34 is secured to the bracket below the reel. One such feed mechanism is manufactured by Hunter Engineering Company of Riverside, California. The wire feed mechanism includes a plurality of drive rollers 36 rotatably mounted on a support frame 37 and driven in unison by a variable speed motor 38 through reduction gearing, not shown. The rollers are provided in substantially opposing pairs which direct the wire downwardly through an induction heater 39 which is suitably secured to the bracket below the feed mechanism and has an annular, open center heating element 41 disposed therein. A guide member 42 is disposed below the heater and is suitably secured to the lower end of the heater. The guide member has an end bore 43 extending therethrough in axial alignment with the open centered heating element and in axially aligned relation with the down sprue 18.

Figure 3:
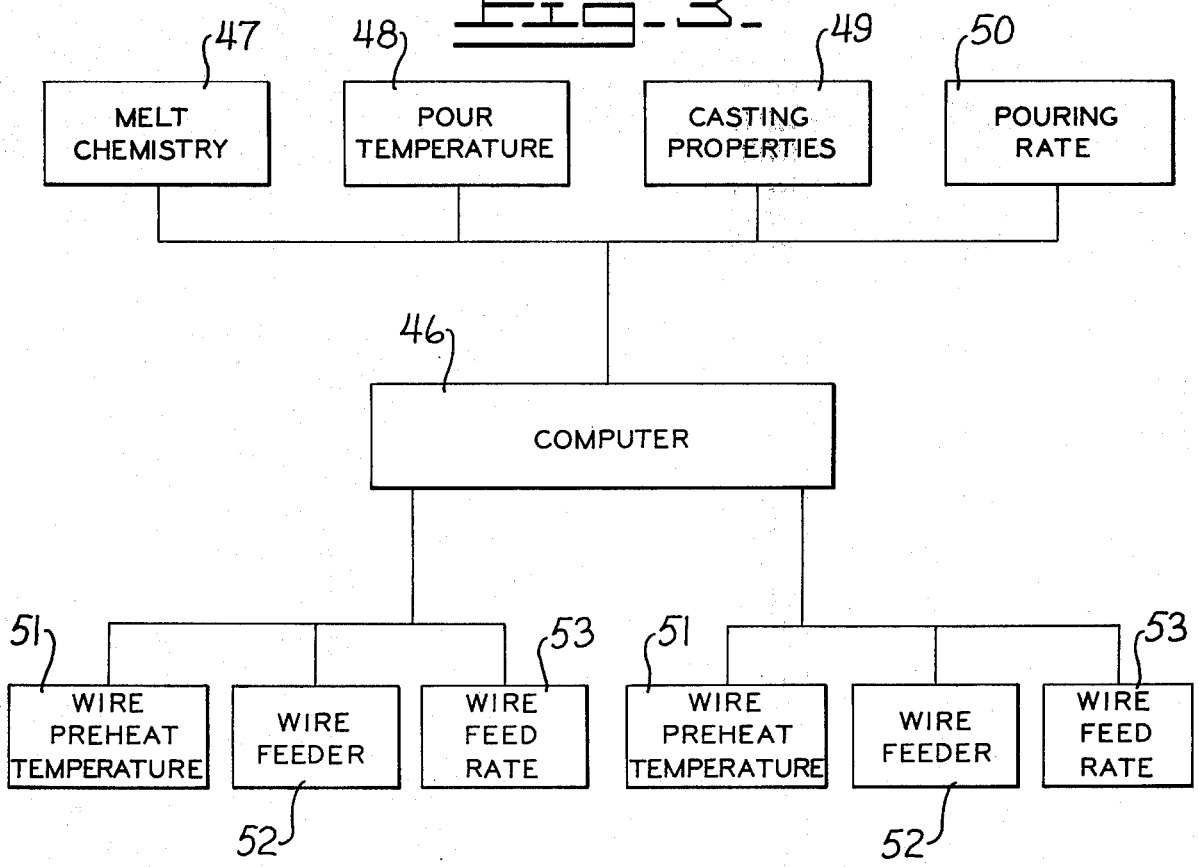
FIG. 3 is a flow diagram schematically illustrating the method steps employed in a casting operation utilizing the apparatus of FIGS. 1 and 2.

As more clearly shown in FIG. 3, a flow diagram schematically illustrates a method of automatically controlling the introduction of additives into the flow of molten metal in the casting mold 11 and includes a computer depicted by the centrally disposed block 46. The computer receives input data such as the melt chemistry, pour temperature, casting properties, and pouring rate as depicted by the blocks 47, 48, 49 and 50, respectively. The computer is responsive to the input data for controlling the wire preheat temperature, wire feeder and wire feed rate as depicted by the blocks 51, 52 and 53, respectively.

SECOND FORM

Figure 2:
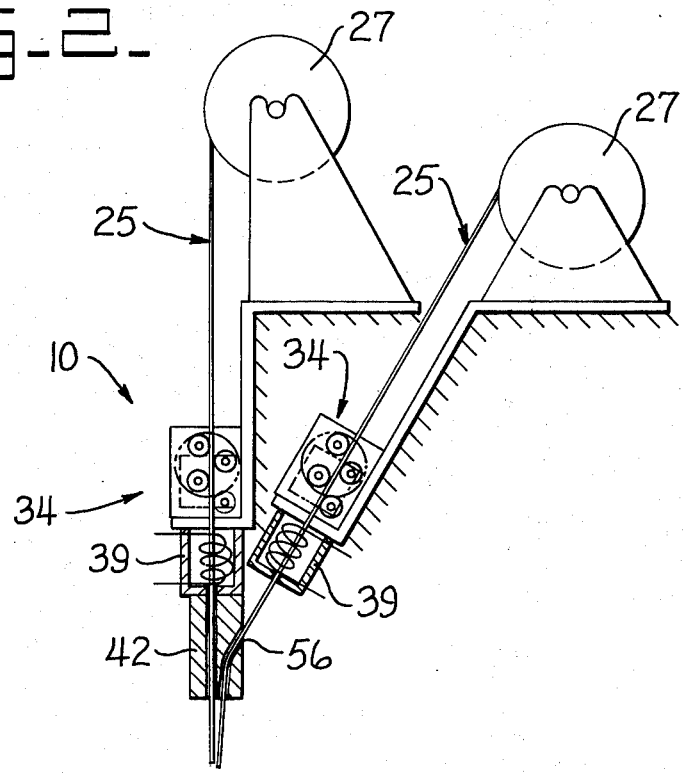
FIG. 2 is a side elevational view of an alternate embodiment of the apparatus for introduction of additives into a casting mold.

An alternate embodiment of the apparatus for introduction of additives into a casting mold 10 of the present invention is disclosed in FIG. 2. It is noted that the same reference numerals utilized in the first embodiment are used to designate similarly constructed counterpart elements of this embodiment. In this embodiment, however, a second spool 27 is provided containing a second wire 25 which may be constructed of a different additive material than the wire of the first form. A second wire feeding mechanism 34 and heater 39 are included to direct the second wire through a guide passage 56 provided in a modified guide member 42 with both wires being directed toward the mid portion of the down sprue 18. The feed mechanisms are operable either independently or simultaneously for the selective feeding of one or both wires into the down sprue.

OPERATION

While the operation of the present invention is believed clearly apparent from the foregoing description, further amplification will subsequently be made in the following brief summary of such operation. The apparatus 10 is employed in a method of introducing additives into the casting mold 11 and includes the steps of pouring the molten metal 21 from the ladle 22 into the pouring basin 19 and the down sprue 18 at a controlled rate. The lower end 26 of the wire 25 is simultaneously fed into the down sprue at a predetermined controlled rate by actuation of the variable speed motor 38 of the wire feed mechanism 34. The wire is of a selected size so that the end thereof is melted or eroded at a substantially uniform rate within the down sprue a predetermined depth below the surface of the molten metal. The molten metal and the additives therein flow through the ingate 17 and into the casting cavity 14. The action of the molten metal as it flows through the ingate thoroughly mixes the eroded additives therein to provide a homogeneous mixture immediately prior to its entry into the casting cavity which thereafter solidifies into a metallic casting of precisely the desired composition.

The desired physical and mechanical properties of the finished casting dictates the chemistry of the base molten metal 21 as well as the composition of the wire 25 to be added by way of the present method and apparatus. The pour rate is determined by the cross sectional area of the down sprue 18 which acts as an orifice or flow control channel and meters a substantially constant flow of molten metal into the cavity with the pouring rate being selected to maintain the surface 23 of the molten metal in the pouring basin 19 substantially constant. The predetermined feed rate of the wire is dependent upon the pouring rate and temperature of the molten metal. The temperature of the molten metal in the ladle 22 is commonly measured by an optical temperature sensor 48 commonly known and marketed under the name Spectray manufactured by Leeds and Northrup. With the pour rate and temperature of the molten metal known, the wire feed rate is calculated and the speed of the variable speed motor 38 of the wire feed mechanism 34 is conveniently adjusted to obtain the calculated optimum feed rate.

The rate at which a given wire is fed into and dissolved by the molten metal may be increased by increasing the temperature of the wire. This is accomplished by selective actuation of the heater 39 to preheat the wire as it is fed into the down sprue 18.

The wire feeding mechanism 34 and heater 39 may be controlled by an operator with the feed rate and preheat temperature manually selectively based on the criteria stated above or automatically controlled by the computer as illustrated by the centrally disposed block 46 in the block diagram shown in FIG. 3. Although the block diagram depicts the controlling of the wire feed rate, wire feeder and wire preheat temperature as illustrated by the blocks 53, 52 and 51, respectively, of a pair of wire feed mechanisms 34 and heaters 31 similar to that shown in FIG. 2, such automatic control is readily adapted for the controlling of a single feed mechanism and heater or a multiplicity of wire feeding mechanisms and heaters. With the automated system, the chemistry of the molten metal is precisely determined by placing a test button of the metal in a spectroquantometer 47 such as a Model 29700 Applied Research Laboratories unit which makes a quantatative chemical analysis of the test button and transmits such information in the form of electrical voltage directly to the computer. Likewise the temperature of the molten metal in the ladle as measured by the optical sensor 48 is transmitted to the computer 46. The other variables such as the casting properties and the pouring rate are prescheduled into the computer program.

The computer analyzes the incoming data and transmits the appropriate signals to the appropriate feed mechanism and heater for directing one or both of the wires into the sprue at the most advantageous rate of feed.

In view of the foregoing, it is readily apparent that the structure of the present invention provides an improved method and apparatus for the introduction of additives into a casting mold which reduces the elapsed time between the introduction of the additives into the molten metal and the time at which the molten metal begins to solidify is minimized. This is particularly important with most additives which have a time dependent decreasing influence between introduction and solidification. The apparatus also provides precise control over the amount of additives introduced into the molten metal. The down sprue serves as an orifice which meters a substantially constant flow of molten metal into the casting cavity with the flow rate being easily calculatable. Thus, the feed rate of the wire or additive is selectively adjusted so that the additives are dissolved in the molten metal at a controlled uniform rate a predetermined depth below the surface of the molten metal. Furthermore, additives which display rapid oxidation or other volatile reaction in an unprotected atmosphere, are introduced well below the surface of the molten metal. The molten metal and additive mix flows through the gate and into the casting chamber with additives being thoroughly dispersed within the molten metal providing a homogeneous mixture.

An additional benefit provided by the present invention is the capability to pour a relatively wide variety of castings, each having a particular chemistry, hardness, or other physical property, from the same base iron. The treatment required for each casting including alloy additives may be easily included in wire form in the down sprue and controlled by the above described process.

While the invention has been described and shown with particular reference to the preferred embodiments, it will be apparent that variations might be possible that would fall within the scope of the present invention which is not intended to be limited except as defined in the following claims.

What is claimed is:

1. A method for automatically introducing additives into a molten metal being poured into a casting cavity formed within a casting mold, comprising the steps feeding a flow of molten metal into a flow path in the casting mold from a pouring device separate from the casting mold;

simultaneously feeding a wire of additive material from a wire feed mechanism positioned above the casting mold into the molten metal flowing through the flow path of the casting mold for erodibly mixing with the molten metal; and automatically controlling the wire feed mechanism and hence the feed rate of the wire as a function of temperature, chemistry and pour rate of the molten metal.

2. A method for introducing additives into a molten metal being poured into a casting cavity formed within a casting mold to control the properties of the resulting casting, comprising the steps of:

feeding a flow of molten metal into and through a flow path provided in the casting mold;

positioning a wire feed mechanism above the casting mold;

feeding a wire of additive material downwardly from the wire feed mechanism into the molten metal flowing through the flow path of the casting mold for erodibly mixing with the molten metal after its entry into the flow path and prior to its entry into the casting cavity; and controlling the wire feed mechanism and hence the feed rate of the wire as a function of the temperature, chemistry and flow rate of the molten metal.

3. A method of forming a casting from a molten base iron having an additive introduced therein, including the steps of:

providing a casting mold having a casting cavity therein and a controlled flow path in communication with the casting cavity;

feeding a flow of the base iron into the flow path in the casting mold from a pouring device separate from the casting mold;

feeding a wire of additive material from a wire feed mechanism remote from the casting mold into the base iron flowing through the flow path of the casting mold for meltably mixing with the base iron; and controlling the wire feed mechanism and hence the feed rate of the wire as a function of temperature, chemistry and pour rate of the base iron to thereby control the composition of the resulting casting.

4. The method of claim 3 including the steps of providing an upwardly extending passageway in the casting mold and feeding the wire of additive material downwardly into the passageway.

5. The method of claim 4 including the steps of positioning the wire feed mechanism above the passageway and guiding the wire directly downwardly into the passageway.

6. The method of claim 4 wherein the step of providing an upwardly extending passageway comprises forming the passageway as a down sprue in the casting mold.

7. The method of claim 6 including the step of controlling the flow of base iron through the flow path to establish and maintain a predetermined level in the down sprue.

8. The method of claim 3 including the step of measuring the chemistry of the base iron with a spectroquantameter.

9. The method of claim 8 including the step of measuring the temperature of the base iron with an optical temperature sensor.

10. The method of claim 3 including the step of automatically controlling the wire feed mechanism to control the rate of feed of the wire of additive material into the flow path to thereby automatically introduce the additive into the base iron and control the composition of the casting.

11. The method of claim 10 including the steps of measuring the chemistry and the temperature of the base iron; and supplying the measurements to a computer which automatically controls the wire feed mechanism.

12. A method for the introduction of additives into a casting mold having a casting cavity formed therein and a controlled flow path in communication with said cavity, comprising the steps of:

directing a flow of molten metal through the controlled flow path into the casting cavity;

simultaneously feeding an endless wire of additive material into the flow path within the mold for erodibly mixing with the molten metal;

selectively varying the feed rate of the endless wire into said flow path for changing the properties of the molten metal and resulting casting;

preheating the wire prior to its entry into the flow path; and automatically controlling the feed rate and preheating of said wire as a function of the temperature, chemistry and pouring rate of the molten metal.

13. An apparatus for introducing additives into a molten metal being poured into a casting mold comprising:

a casting mold having an internal casting cavity and means defining a controlled flow path communicating with the casting cavity;

pouring means separate from the mold for holding and feeding a flow of molten metal into the flow path and therethrough into the casting cavity;

means for holding a supply of wire of additive material;

a wire feed mechanism positioned above the casting mold for feeding the wire from the holding means into the flow path of the casting mold; and control means operatively connected to said wire feed mechanism for controlling said wire feed mechanism as a function of temperature, chemistry and pour rate of the molten metal.

14. The apparatus of claim 13 wherein said flow path includes a down sprue and a pouring basin in communication with said down sprue, and wherein said pouring means is a ladle positioned for feeding the molten metal into the pouring basin.

15. The apparatus of claim 13 including a spectroquantameter operatively connected to said control means for measuring the chemistry of the molten metal.

16. The apparatus of claim 13 including a temperature sensor operatively connected to said control means for measuring the temperature of the molten metal.

17. The apparatus of claim 13 wherein said control means is a computer for receiving measurements concerning chemistry and temperature of the molten metal and for controlling the wire feed mechanism to automatically control the rate of feed of the wire of additive material into the flow path to thereby automatically introduce the additive into the molten metal and control the composition of the resulting casing.

18. The apparatus of claim 13 wherein the wire feed mechanism includes a drive roller for feeding the wire into the flow path.

19. The apparatus of claim 18 wherein the wire feed mechanism includes a variable speed drive motor powerably driving said drive roller for selective adjustment of the feed rate of said wire into said flow path.

20. The apparatus of claim 19 including a guide member disposed between the wire feed mechanism and said casting mold, said guide member having a passage formed therethrough for guiding said wire into said flow path.

21. The apparatus of claim 19 wherein the wire feed drive motor is manually controllable.

22. The apparatus of claim 19 wherein the control means automatically controls the wire feed mechanism to control the rate of feed of the wire.

23. The apparatus of claimm 22 wherein said automatic control means is a computer which receives input data and varies the rate of feed of the wire in response thereto.

24. An apparatus for the introduction of additives in wire form into a molten base iron being poured into a casting mold comprising: a casting mold having an internal casting cavity, a pouring basin for receiving the molten base iron, a controlled flow path connecting the pouring basin with the casting cavity, and said flow path including a down sprue in communication with the pouring basin for controlling the flow rate through the flow path so that a predetermined level of molten base iron is substantially established and maintained in the pouring basin; pouring means separate from the mold for holding the molten base iron and feeding a flow of the molten base iron into the pouring basin and through the flow path into the casting cavity; a wire feed mechanism remote from the casting mold for feeding a wire of additive material downwardly into the down sprue with the end of the wire submerged a preselected distance below said predetermined level of the molten base iron for meltably mixing with the molten base iron after its entry into the down sprue and prior to its entry into the casting cavity, said wire feed mechanism having a drive roller and a variable speed drive motor for powerably driving the drive roller for selective adjustment of the feed rate of the wire of additive material into the molten base iron in the down sprue; whereby the additive material is mixed with the molten base iron below said predetermined level and prior to entry into the casting cavity; and means operatively connected to said wire feed mechanism for automatically controlling the wire feed mechanism to automatically control the feed rate of the wire of additive material into the flow path to thereby automatically introduce the additive into the molten base iron and control the composition of the resulting casting.

25. The apparatus of claim 24 including a guide member disposed between said feeding means and said casting mold, said guide member defining a passage disposed in substantial alignment with said down sprue for guiding the wire into said down sprue.

26. An apparatus for automatically introducing additives into a molten metal being poured into a casting mold comprising:

a casting mold having an internal casting cavity and means defining a controlled flow path communicating with the casting cavity;

pouring means separate from the mold for holding and feeding a flow of molten metal into the flow path and therethrough into the casting cavity;

means for holding a supply of wire of additive material;

a wire feed mechanism positioned above the casting mold for feeding the wire from the holding means into the flow path of the casting mold; and means operatively connected to said wire feed mechanism for automatically controlling said wire feed mechanism as a function of the temperature, chemistry and pour rate of the molten metal.

27. The apparatus of claim 26 including a spectroquantometer for measuring the chemistry of the molten metal; and an optical temperature sensor for measuring the temperature of the molten metal; and wherein said controlling means is a computer operatively connected to said spectroquantometer and said optical temperature sensor for receiving said measurements and for controlling the wire feed mechanism to control the rate of feed of the wire into the flow path to thereby automatically introduce the additive into the molten metal and control the chemistry of the resulting casting.

28. The apparatus of claim 27 wherein said flow path includes a down sprue and a pouring basin in communication with said down sprue, and wherein said pouring means is a ladle positioned for feeding molten metal into the pouring basin.

29. The apparatus of claim 28 wherein the wire feed mechanism includes a drive roller and a variable speed drive motor powerably driving said drive roller for selective adjustment of the feed rate of said wire into said flow path.

30. The apparatus of claim 29 including a heater disposed between said wire feed mechanism and said casting mold and controlled by the computer for preheating the wire as it is fed into the flow path.

31. An apparatus for the introduction of additives into a casting mold, comprising:

a casting mold providing an internal casting cavity, and a controlled plow path in communication with said casting cavity;

means for directing a flow of molten metal through said flow path into said casting cavity;

means for continuously feeding a substantially endless wire of additive material into said flow path for erodibly substantially completely mixing with said molten metal prior to its entry into said casting cavity, said feeding means including a wire feed mechanism having a drive roller and a variable speed drive motor powerably driving the drive motor for selective adjustment of the feed rate of the wire into said flow path;

means for selectively preheating said wire prior to its entrance into said flow path, said preheating means including an induction heater disposed between said feed mechanism and said casting mold;

a guide member disposed between said feeding mechanism and said casting mold, said guide member having a passage formed therethrough for receiving and guiding the wire into said flow path; and means operatively connected to the wire feed mechanism and the heater for controlling said wire feed mechanism and said heater as a function of the temperature, chemistry and pour rate of the molten metal.

* * * * *